US008472835B2

(12) United States Patent
Suzuki et al.

(10) Patent No.: US 8,472,835 B2
(45) Date of Patent: Jun. 25, 2013

(54) FIXING DEVICE WITH GROUNDED FUSING FILM

(75) Inventors: Noboru Suzuki, Komaki (JP); Kei Ishida, Aichi (JP); Yasushi Fujiwara, Itami (JP); Tsuneo Fujiwara, legal representative, Itami (JP); Etsuko Fujiwara, legal representative, Itami (JP); Yoshihiro Miyauchi, Ama (JP); Tomohiro Kondo, Aichi (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 163 days.

(21) Appl. No.: 13/031,417

(22) Filed: Feb. 21, 2011

(65) Prior Publication Data

US 2011/0206406 A1 Aug. 25, 2011

(30) Foreign Application Priority Data

Feb. 22, 2010 (JP) ..... 2010-035805

(51) Int. Cl.
*G03G 15/20* (2006.01)

(52) U.S. Cl.
USPC ..... 399/90; 399/329; 399/122

(58) Field of Classification Search
USPC ..... 399/122, 329, 330, 90
See application file for complete search history.

(56) References Cited

U.S. PATENT DOCUMENTS

| | | | | |
|---|---|---|---|---|
| 5,115,278 | A | 5/1992 | Maruta et al. | |
| 5,303,016 | A * | 4/1994 | Oda et al. | 399/329 |
| 5,331,385 | A * | 7/1994 | Ohtsuka et al. | 399/331 |
| 5,410,386 | A * | 4/1995 | Swift et al. | 399/90 |
| 6,014,539 | A * | 1/2000 | Sano et al. | 399/329 |
| 6,542,712 | B2 * | 4/2003 | Kamijo et al. | 399/328 |
| 7,792,476 | B2 * | 9/2010 | Seol et al. | 399/329 |
| 7,881,650 | B2 * | 2/2011 | Shin et al. | 399/329 |
| 7,986,909 | B2 * | 7/2011 | Nanba | 399/329 |
| 8,195,058 | B2 * | 6/2012 | Takenaka et al. | 399/69 |
| 2009/0208264 | A1 * | 8/2009 | Fujiwara et al. | 399/329 |
| 2011/0091236 | A1 * | 4/2011 | Oi et al. | 399/90 |
| 2011/0236090 | A1 * | 9/2011 | Uchiyama et al. | 399/329 |

FOREIGN PATENT DOCUMENTS

| | | | |
|---|---|---|---|
| JP | 03-025476 | | 2/1991 |
| JP | H10-048977 | A | 2/1998 |
| JP | H10-133502 | A | 5/1998 |
| JP | H11-258932 | A | 9/1999 |
| JP | 2006-047769 | A | 2/2006 |
| JP | 2008-233886 | | 10/2008 |
| JP | 2009053507 | A | 3/2009 |

OTHER PUBLICATIONS

JP Office Action dtd Jan. 24, 2012, JP Appln. 2010-035805, English translation.

* cited by examiner

*Primary Examiner* — David Gray
*Assistant Examiner* — Carla Therrien
(74) *Attorney, Agent, or Firm* — Banner & Witcoff, Ltd.

(57) ABSTRACT

There is provided a fixing device for thermally fixing a developing agent image to a sheet. The fixing device includes a tubular flexible member, a heater, a nip member and a backup member. The tubular flexible member has an inner peripheral surface defining an internal space. The heater is disposed within the internal space and is configured to generate a radiant heat. The nip member is disposed within the internal space and is configured to receive the radiant heat from the heater, the inner peripheral surface being in sliding contact with the nip member, and the nip member being electrically conductive and the tubular flexible member being grounded via the nip member. The backup member is configured to provide a nip region in cooperation with the nip member for nipping the tubular flexible member between the backup member and the nip member.

8 Claims, 9 Drawing Sheets

FIXING DEVICE WITH GROUNDED FUSING FILM

CROSS REFERENCE TO RELATED APPLICATION

This application claims priority from Japanese Patent Application No. 2010-035805 filed Feb. 22, 2010. The entire content of the priority application is incorporated herein by reference.

TECHNICAL FIELD

The present invention relates to a fixing device that thermally fixes a transferred developing agent image to a sheet.

BACKGROUND

A well-known thermal fixing device includes an endless fusing film, a heater disposed in an internal space of the fusing film, a pressure roller, and a heating plate (nip member) defining a nip region relative to the pressure roller through the fusing film. The guide members are disposed respectively on both widthwise ends of the fusing film. While a recording sheet is conveyed between the fusing film (nip member) and the pressure roller, a developing agent image formed on the recording sheet is thermally fixed.

SUMMARY

In such a fixing device, when the fusing film is charged, part of the developing agent deposited on the recording sheet may adhere to the fusing film, which may cause the pressure roller and a next recording sheet to be contaminated. Further, when the fusing film is charged, a developing agent image that has not yet been fixed on the next recording sheet may be disturbed, leading to degradation of image quality.

In view of the foregoing, it is an object of the present invention to provide a fixing device capable of suppressing a fusing film from being charged.

In order to attain the above and other objects, there is provided a fixing device for thermally fixing a developing agent image to a sheet. The fixing device includes a tubular flexible member, a heater, a nip member and a backup member. The tubular flexible member has an inner peripheral surface defining an internal space. The heater is disposed within the internal space and is configured to generate a radiant heat. The nip member is disposed within the internal space and is configured to receive the radiant heat from the heater, the inner peripheral surface being in sliding contact with the nip member, and the nip member being electrically conductive and the tubular flexible member being grounded via the nip member. The backup member is configured to provide a nip region in cooperation with the nip member for nipping the tubular flexible member between the backup member and the nip member.

DETAILED DESCRIPTION

First, a general configuration of a laser printer 1 (as an image forming device) in which a fixing device 100 according to an embodiment of the present invention is disposed will be described with reference to FIG. 1. A general structure of the laser printer 1 will firstly be described. Then, a detailed structure of the fixing device 100 will be described.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side are referred to as a front side, a rear side, a left side and a right side, respectively.

Figure 1:
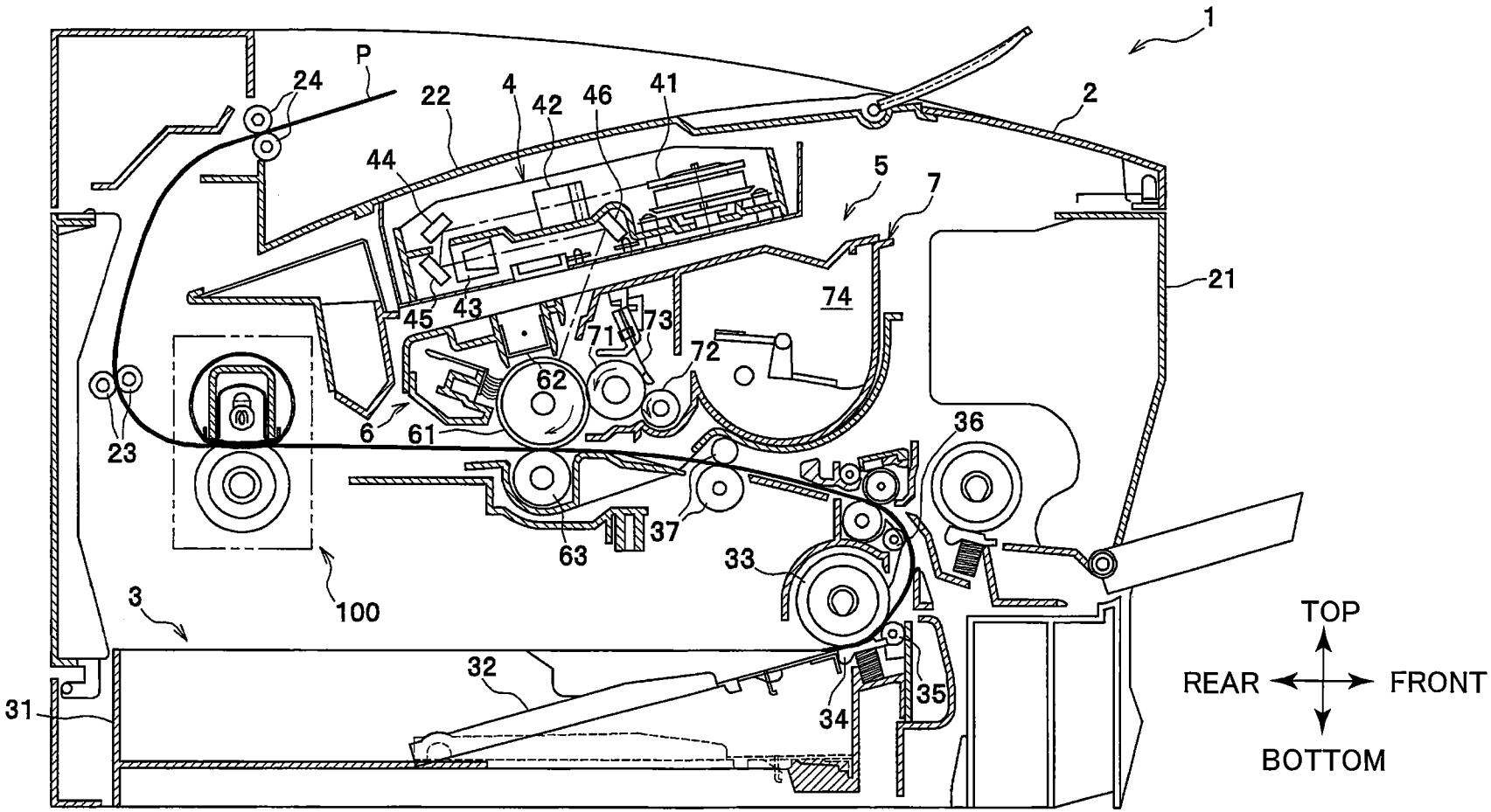
FIG. 1 is a schematic cross-sectional view illustrating a general configuration of a laser printer provided with a fixing device according to an embodiment of the present invention.

As shown in FIG. 1, the laser printer 1 includes a main frame 2 provided with a movable front cover 21. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and a pair of registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 via the paper dust removing rollers 35, 36, and the pair of registration rollers 37.

The exposure unit 4 is disposed at an upper portion of the main frame 2. The exposure unit 4 includes a laser emission unit (not shown), a polygon mirror 41, lenses 42, 43, and reflection mirrors 44, 45, 46. In the exposure unit 4, the laser emission unit emits a laser beam (indicated by a chain line in FIG. 1) based on image data so that the laser beam is reflected by or passes through the polygon mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachably loadable in the main frame 2 through a front opening defined when the front cover 21 of the main frame 2 is opened. The process cartridge 5 includes a drum unit 6 and a developing unit 7.

The drum unit 6 includes the photosensitive drum 61, a charger 62, and a transfer roller 63. The developing unit 7 is detachably mounted on the drum unit 6. The developing unit 7 includes a developing roller 71, a toner supply roller 72, a thickness-regulation blade 73, and a toner accommodating portion 74 in which toner (developing agent) is accommodated.

In the process cartridge 5, after the surface of the photosensitive drum 61 has been uniformly charged by the charger 62, the surface is exposed to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner then enters between the developing roller 71 and the thickness-regulation blade 73 to be carried on the developing roller 71 as a thin layer having a uniform thickness.

The toner borne on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is then conveyed by conveying rollers 23, 24 to be discharged onto a discharge tray 22 formed on an upper surface of the main frame 2.

Next, a detailed structure of the fixing device 100 according to the embodiment of the present invention will be described with reference to FIGS. 2 through 8.

Figure 2:
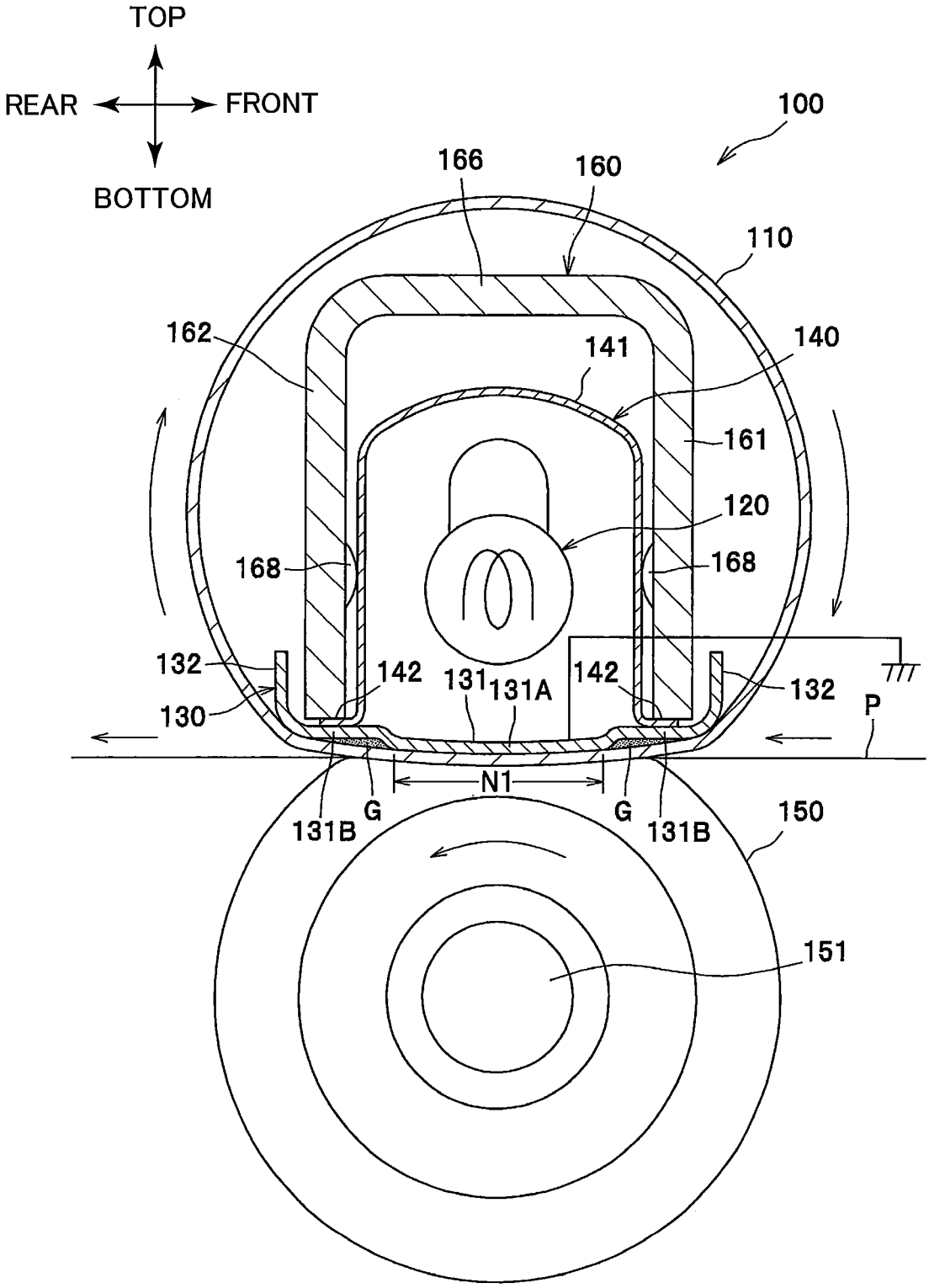
FIG. 2 is a schematic cross-sectional view illustrating a general configuration of the fixing device according to the embodiment.

As shown in FIG. 2, the fixing device 100 includes a flexible tubular fusing film 110, a halogen lamp 120 as a heater, a nip plate 130 as a nip member, a reflection plate 140 as a reflection member, a pressure roller 150 as a backup member and a stay 160.

In the following description, a direction in which the sheet P is fed (a frontward/rearward direction) will be simply referred to as a sheet feeding direction; a widthwise direction of the sheet P (a lateral or rightward/leftward direction) will be simply referred to as a widthwise direction.

The fusing film 110 is of an endless film (of a tubular configuration) having heat resistivity and flexibility. The fusing film 110 has an internal space within which the halogen lamp 120, the nip plate 130, the reflection plate 140 and the stay 160 are disposed, as shown in FIG. 2. The fusing film 110 has widthwise (right and left) end portions that are respectively guided by a pair of guide members 170 (see FIG. 6A) so that the fusing film 110 is circularly movable. The fusing film 110 may be a metal film or a resin film. Alternatively, the fusing film 110 may be a film whose outer circumferential surface is coated with a rubber.

The halogen lamp 120 is a heater to heat the nip plate 130 to heat the fusing film 110 for heating toner on the sheet P. The halogen lamp 120 is positioned at the internal space of the fusing film 110 such that the halogen lamp 120 is spaced away from an inner surface of the nip plate 130 by a predetermined distance.

Figure 3:
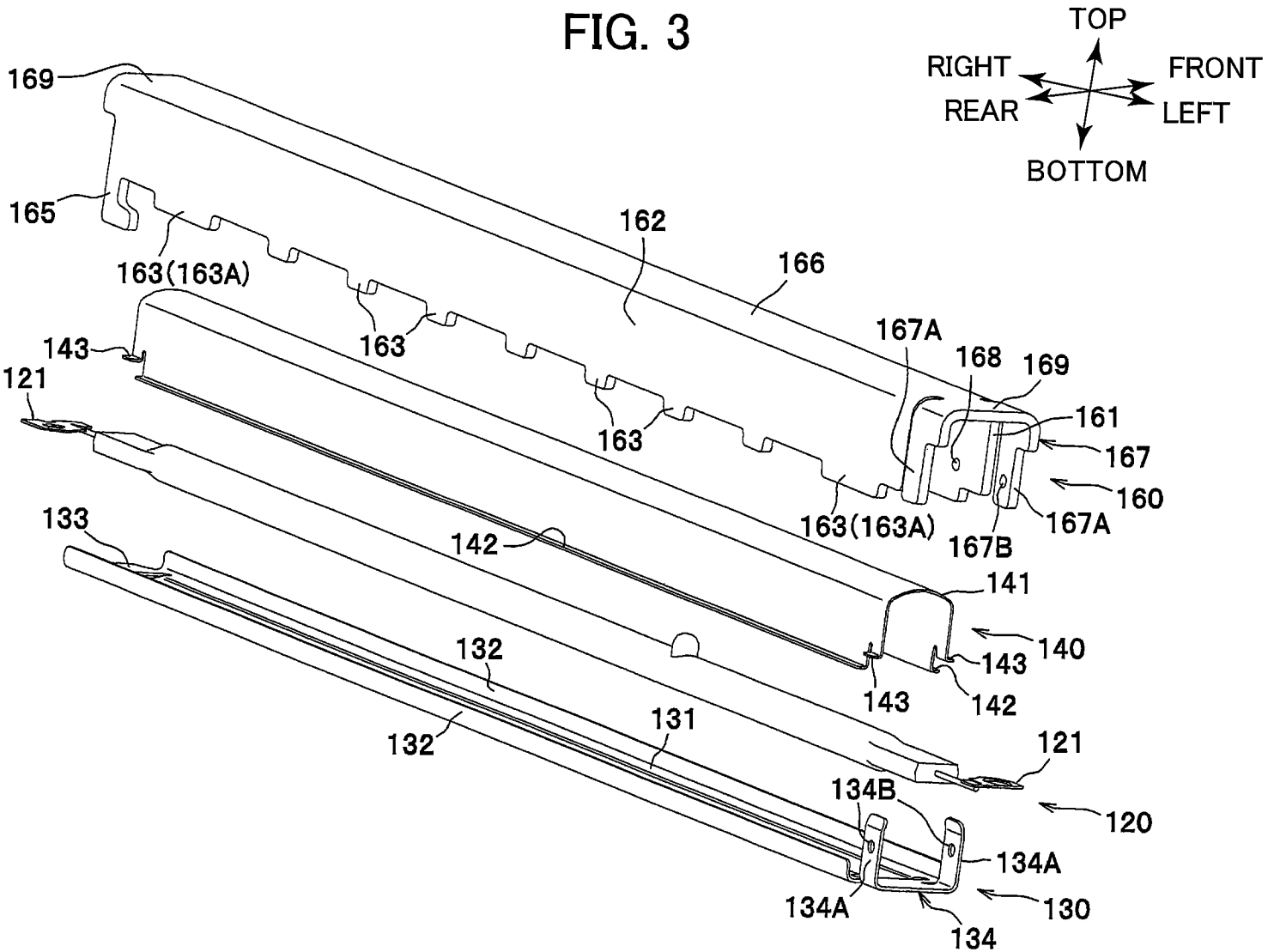
FIG. 3 is an exploded perspective view of the fixing device according to the embodiment, the fixing device including a halogen lamp, a nip plate, a reflection plate and a stay.

The halogen lamp 120 has right and left end portions and each end portion is provided with a planar terminal 121 (FIG. 3).

The nip plate 130 is adapted for transmitting radiation heat from the halogen lamp 120 to the toner on the sheet P through the fusing film 110. To this effect, the nip plate 130 is stationarily positioned such that an inner circumferential surface of the fusing film 110 is slidably movable with a lower surface of the nip plate 130.

The nip plate 130 is made from a material such as aluminum having a thermal conductivity higher than that of the stay 160 (described later) made from a steel. The nip plate 130 is therefore conductive. More specifically, for fabricating the nip plate 130, an aluminum plate is bent into a U-shape to provide a base portion 131 and two folded portions 132.

The base portion 131 has a center portion 131A in the sheet feeding direction and front and rear end portions 131B. The center portion 131A protrudes toward the inner circumferential surface of the fusing film 110 (i.e., toward the pressure roller 150). The base portion 131 may have an inner (upper) surface painted with a black color or provided with a heat absorbing member so as to efficiently absorb radiant heat from the halogen lamp 120. The folded portions 132 extend upward respectively from the front and rear end portions 131B of the base portion 131.

Figure 8:
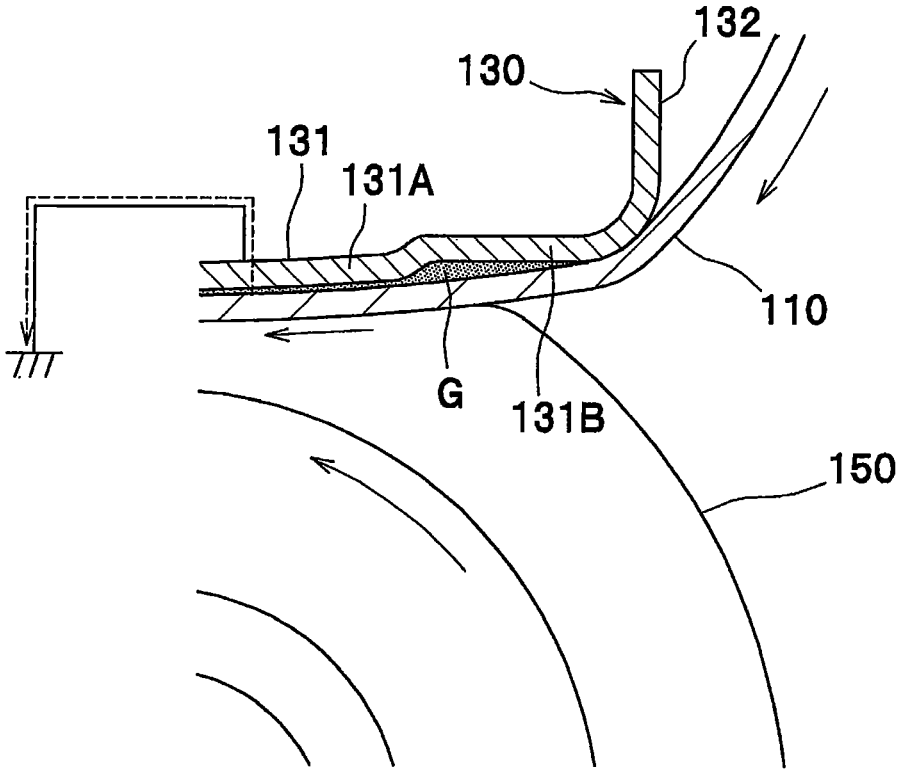
FIG. 8 is a partially enlarged cross-sectional view explaining a relationship of the nip plate relative to the fusing film in the fixing device according to the embodiment.

A lubricant agent G is retained between the lower surface of the base portion 131 (nip plate 130) and the inner circumferential surface of the fusing film 110 to reduce sliding resistance generated therebetween (See FIGS. 2 and 8). The lubricant agent G does not have electrically conductive properties. With provision of the lubricant agent G, the fusing film 110 can silidingly move smoothly relative to the lower surface of the nip plate 130. As the lubricant agent G, a heat-resisting fluorine grease is available, for example.

As shown in FIG. 3, the base portion 131 has a right end portion provided with an insertion portion 133 extending flat, and a left end portion provided with an engagement portion 134. The engagement portion 134 has a U-shaped configuration as viewed from a left side and includes a pair of side wall portions 134A extending upward. Each side wall portion 134A is formed with an engagement hole 134B.

The reflection plate 140 is adapted to reflect radiant heat radiating from the halogen lamp 120 toward the nip plate 130 (toward the inner surface of the base portion 131). As shown in FIG. 2, the reflection plate 140 is positioned within the fusing film 110 and surrounds the halogen lamp 120, with a predetermined distance therefrom. Thus, heat from the halogen lamp 120 can be efficiently concentrated onto the nip plate 130 to promptly heat the nip plate 130 and the fusing film 110.

The reflection plate 140 is configured to have a U-shaped cross-section and is made from a material such as aluminum having high reflection ratio regarding infrared ray and far infrared ray. The reflection plate 140 is therefore conductive. The reflection plate 140 has a U-shaped reflection portion 141 and a flange portion 142 extending from each end portion of the reflection portion 141 in the sheet feeding direction. A mirror surface finishing is available on the surface of the aluminum reflection plate 140 for specular reflection in order to enhance heat reflection ratio.

As shown in FIG. 3, two engagement sections 143 are formed at each widthwise end of the reflection plate 140 (only three of four engagement sections 143 are shown in FIG. 3). Each engagement section 143 is positioned higher than the flange portion 142.

The pressure roller 150 is positioned below the nip plate 130. The pressure roller 150 nips the fusing film 110 in cooperation with the nip plate 130 to provide a nip region N1 for nipping the sheet P between the pressure roller 150 and the fusing film 110.

The pressure roller 150 has a shaft 151 extending in the widthwise direction. The shaft 151 has a rotational axis about which the pressure roller 150 is rotatable. The pressure roller 150 is rotationally driven by a drive motor (not shown) disposed in the main frame 2. By the rotation of the pressure roller 150, the fusing film 110 is circularly moved along the nip plate 130 because of a friction force generated between the pressure roller 150 and the sheet P, and between the sheet P and the fusing film 110. The toner image on the sheet P can be thermally fixed thereon by heat and pressure applied while the sheet P passes between the pressure roller 150 and the fusing film 110 (the nip region N1).

The stay 160 is adapted to support the front and rear end portions 131B of the nip plate 130 via the flange portions 142 of the reflection plate 140 for maintaining rigidity of the nip plate 130. The stay 160 has a U-shaped configuration in conformity with an outer profile of the reflection portion 141 for covering the reflection plate 140. For fabricating the stay 160, a highly rigid member such as a steel plate is folded into U-shape to provide a top wall 166, a front wall 161 and a rear wall 162. The stay 160 is thus conductive.

As shown in FIG. 3, each of the front wall 161 and the rear wall 162 of the stay 160 has a lower end portion 163 formed with comb-like contact portions 163.

As a result of assembly of the nip plate 130 together with the reflection plate 140 and the stay 160, the comb-like contact portions 163 are nipped between the right and left engagement sections 143. That is, the right engagement section 143 is in contact with the rightmost contact portion 163A, and the left engagement section 143 is in contact with the leftmost contact portion 163A. As a result, displacement of the reflection plate 140 in the widthwise direction due to vibration caused by operation of the fixing device 100 can be restrained by the engagement between the engagement sections 143 and the comb-like contact portions 163A.

The front and rear walls 161, 162 have right end portions formed with substantially L-shaped engagement legs 165 each extending downward and then leftward. The insertion portion 133 of the nip plate 130 is insertable into a space between the confronting engagement legs 165 and 165. Further, each end portion 131B of the base portion 131 is abuttable on each engagement leg 165 as a result of the insertion.

The top wall 166 has a left end portion provided with a U-shaped retainer 167. The retainer 167 has a pair of retaining walls 167A whose inner surfaces are provided with engagement bosses 167B each being engageable with each engagement hole 134B.

As shown in FIGS. 2 and 3, each of the front wall 161 and the rear wall 162 has widthwise end portions whose inner surfaces are respectively provided with two abutment bosses 168 protruding inward in abutment with the reflection portion 141 in the sheet feeding direction. Therefore, displacement of the reflection plate 140 in the sheet feeding direction due to vibration caused by operation of the fixing device 100 can be restrained because of the abutment of the reflection portion 141 with the abutment bosses 168.

The stay 160 has upper left and right end portions, each provided with a supported portion 169 protruding outward in the widthwise direction. Each of the supported portions 169 is supported to the guide member 170, as will be described later.

Assembling procedure of the reflection plate 140 and the nip plate 130 to the stay 160 will now be described. First, the reflection plate 140 is temporarily assembled to the stay 160 by the abutment of an outer surface of the reflection portion 141 on the abutment bosses 168. At this time, the engagement sections 143 are in contact with the widthwise endmost contact portions 163A.

Figure 4:
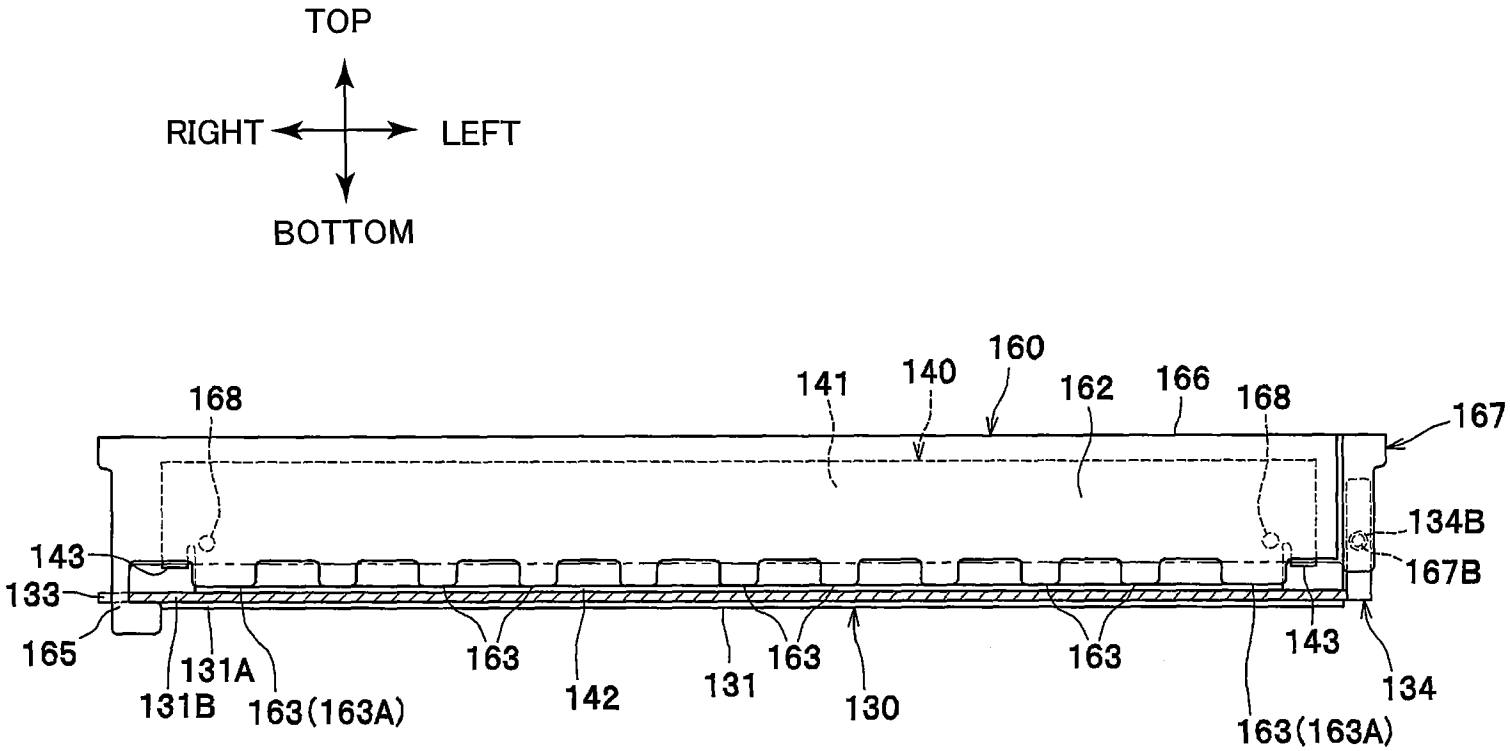
FIG. 4 is a rear side view illustrating an assembled state of the nip plate, the reflection plate and the stay in the embodiment.

Then, as shown in FIG. 4, the insertion portion 133 of the nip plate 130 is inserted between the confronting engagement legs 165, so that the base portion 131 (both end portions 131B) can be brought into engagement with the engagement legs 165. Thereafter, the engagement bosses 167B of the retainer 167 are engaged with the corresponding engagement holes 134B of the engagement portion 134. By this engagement, each flange portion 142 is sandwiched between the nip plate 130 (each end portion 131B) and the stay 160. Thus, the nip plate 130 and the reflection plate 140 are held to the stay 160.

Thus, vertical displacement of the reflection plate 140 due to vibration caused by operation of the fixing device 100 can be restrained, since the flange portions 142 are held between the nip plate 130 and the stay 160. Therefore, position of the reflection plate 140 relative to the nip plate 130 can be fixed.

Each end portion 131B of the nip plate 130 and the corresponding flange portion 142 of the reflection plate 140 are electrically connected to each other. Further, each flange portion 142 of the reflection plate 140 and the contact portions 163 of the stay 160 are also electrically connected to each other. In this way, since the reflection plate 140 and the nip plate 130 are electrically connected to each other, the stay 160 is electrically connected to the nip plate 130 via the reflection plate 140.

The stay 160 holding the nip plate 130 and the reflection plate 140, and the halogen lamp 120 are directly fixed to the pair of the guide members 170. The guide members 170 are supported to a fixing frame 180 constituting a casing of the fixing device 100.

Figure 6A:
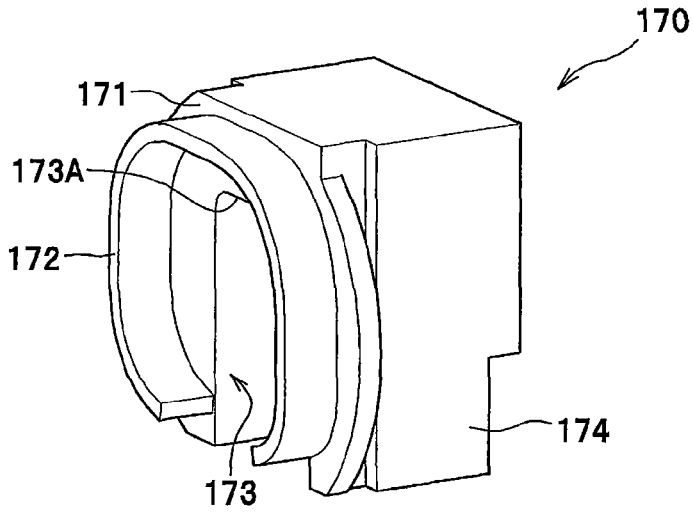
FIG. 6A is a perspective view of a guide member as viewed from a top side thereof in the embodiment.

Each of guide members 170 is disposed at each of the widthwise end portions of the fusing film 110 to restrain movement of the fusing film 110 in the widthwise direction. The guide member 170 is formed of an electrically-conductive material, such as an electrically-conductive resin. More specifically, as shown in FIG. 6A, the guide member 170 includes a restricting surface 171 for restricting widthwise movement of the fusing film 110, a guide portion 172 and a supporting recess 173.

The guide portion 172 is a rib protruding inward from the restricting surface 171 in the widthwise direction. The guide portion 172 has a generally C-shape having a bottom opening. The guide portion 172 is inserted into the tubular fusing film 110. That is, the guide portion 172 is in sliding contact with the inner peripheral surface of the fusing film 110 so as to restrain radially inward deformation of the fusing film 110. The bottom opening of the guide portion 172 serves as a space for accommodating the stay 160 that is inserted into the supporting recess 173.

Figure 6B:
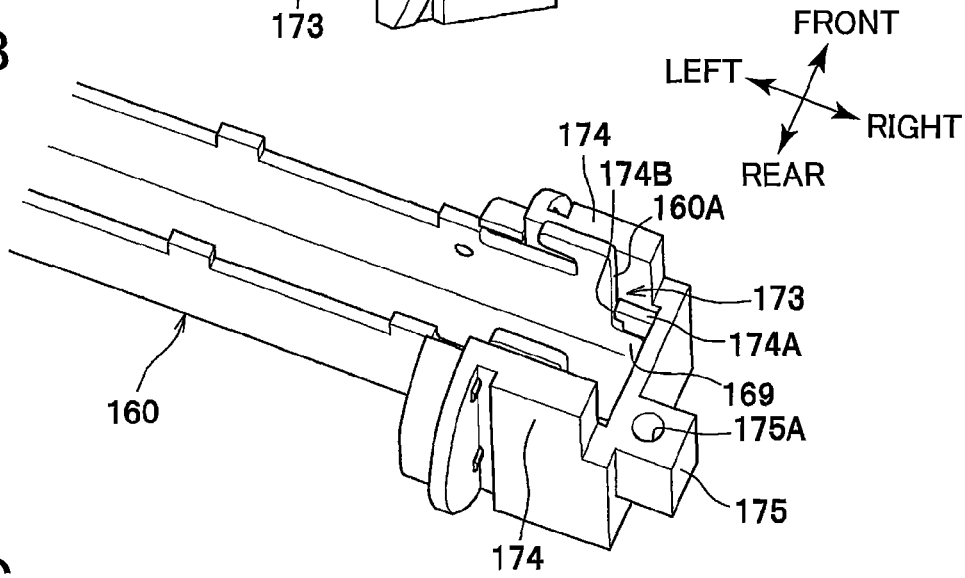
FIG. 6B is a perspective view of the guide member to which the stay is assembled as viewed from a bottom side thereof in the embodiment.
Figure 6C:
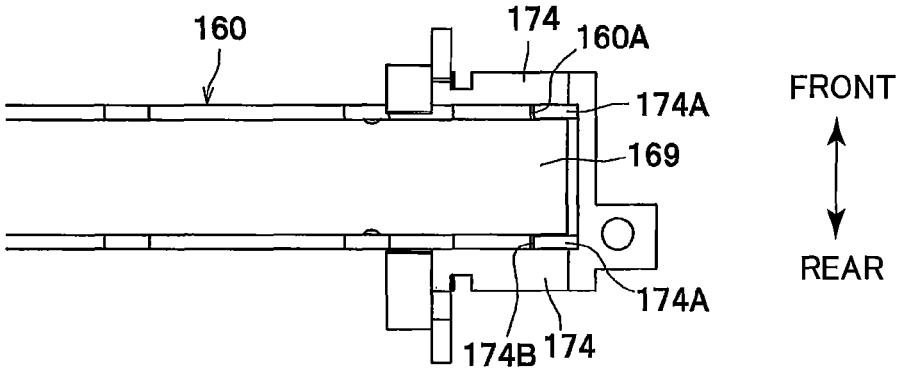
FIG. 6C is a bottom view of the guide member to which the stay is assembled in the embodiment.

The supporting recess 173 opens inward in the widthwise direction and has a bottom opening. The supporting recess 173 has a top wall 173A (FIG. 6A) The guide member 170 has a pair of side walls 174 arranged in confrontation with each other in the sheet feeding direction (frontward/rearward direction). The pair of the side walls 174 defines the supporting recess 173 therebetween. Each of the side walls 174 has a protruding portion 174A as shown in FIGS. 6B and 6C. The protruding portion 174A is formed so as to protrude inward from each side wall 174 at a position away from the top wall 173A.

As shown in FIG. 6B, each of the supported portions 169 of the stay 160 is inserted into a space defined by the top wall 173A and the pair of the protruding portions 174A. Hence, vertical movement of the supported portion 169 can be restricted by the top wall 173A and the pair of the protruding portions 174A. As a result, vertical displacement of the stay 160 relative to the guide member 170 can be restrained.

Further, each of the protruding portions 174A has an inner surface 174B in the widthwise direction. The stay 160 has a pair of outer edge portions 160A (FIGS. 6B and 6C) in the widthwise direction. Each of the outer edge portions 160A is brought into abutment with each of the inner surfaces 174B. As a result, displacement of the stay 160 relative to the guide member 170 in the widthwise direction due to vibration caused by operation of the fixing device 100 can be restrained by abutment of the protruding portions 174A with the stay 160.

Further, displacement of the stay 160 in the sheet feeding direction (frontward/rearward direction) can be restrained, since the stay 160 is supported between the pair of the side walls 174. As described above, the stay 160 is supported to the guide member 170, so that the nip plate 130 and the reflection plate 140 are integrally supported to the guide member 170 via the stay 160.

Figure 5:
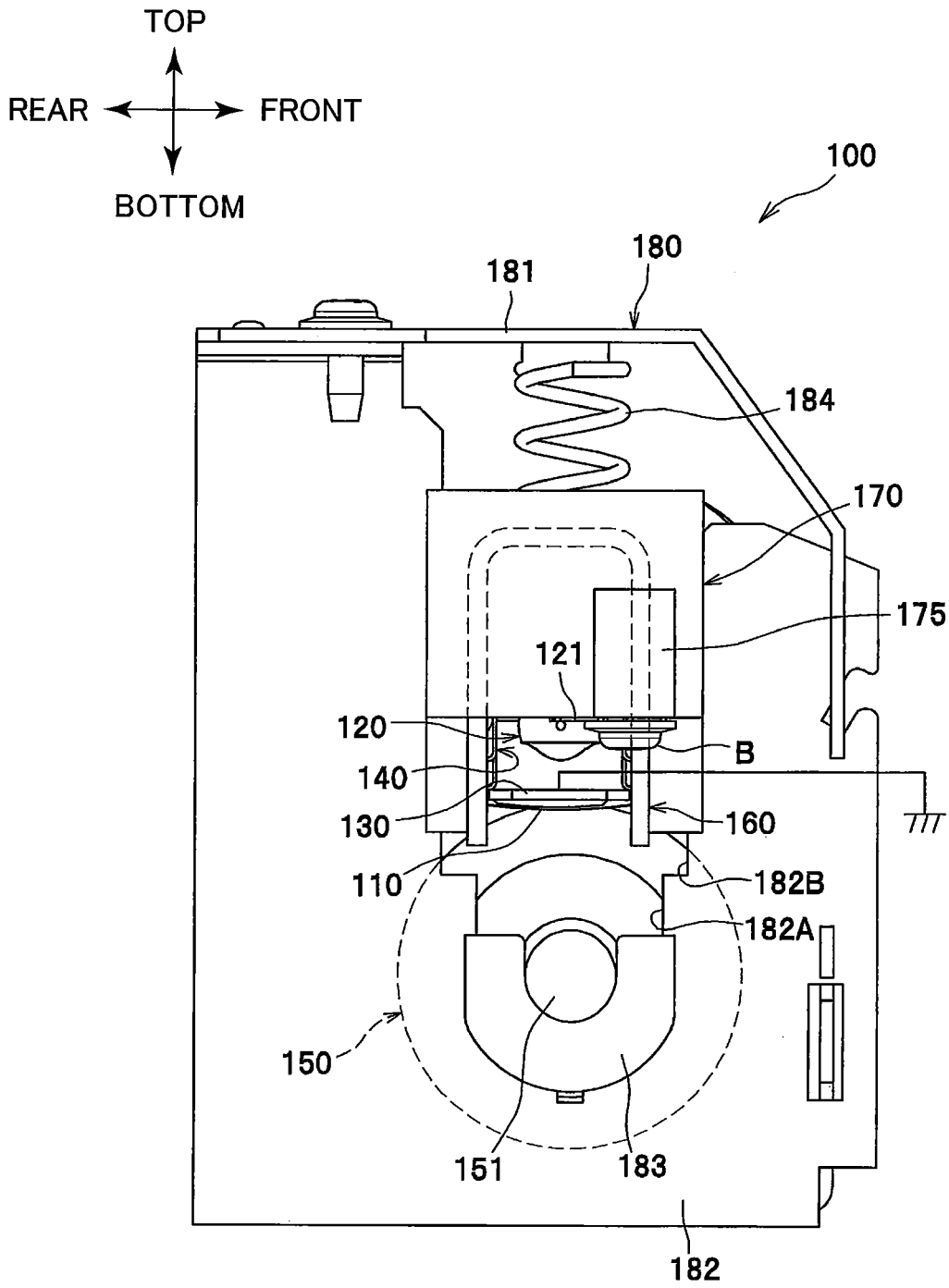
FIG. 5 is a left side view of the fixing device according to the embodiment.

As shown in FIGS. 6B and 6C, the guide member 170 has a holding portion 175 protruding outward from the guide member 170 in the widthwise direction. The holding portion 175 is provided to fix the halogen lamp 120 to the guide member 170. The holding portion 175 has a lower surface formed with a hole 175A into which a bolt B (FIG. 5) is inserted. As shown in FIG. 5, the terminal 121 of the halogen lamp 120 is directly fixed to the lower surface of the holding portion 175 by the bolt B.

The fixing frame 180 includes an upper casing 181 formed of an electrically insulative material, a lower casing 182 that is supported to the upper casing 181, and bearing members 183, as shown in FIG. 5.

The lower casing 182 has electrically conductive properties. For fabricating the lower casing 182, a steel plate is folded into U-shape as viewed from the sheet feeding direction. The lower casing 182 has a pair of side walls (left and right walls) each being formed with a bearing groove 182A and a supporting groove 182B. The bearing grooves 182A rotatably support the shaft 151 of the pressure roller 150 via the bearing member 183. The supporting grooves 182B support the guide member 170 such that the guide member 170 can make vertical movements.

The bearing members 183 rotatably support the shaft 151 of the pressure roller 150. The bearing member 183 is formed of a material having electrically-conductive properties, such as an electrically-conductive resin. The shaft 151 of the pressure roller 150 is formed of an aluminum or a steel, for example, to be electrically conductive.

A pair of coil spring 184 is provided between the upper casing 181 and each of the guide members 170. The coil springs 184 constantly bias the guide members 170 downward (toward the pressure roller 150). With this configuration, at least when a printing operation is performed, the nip plate 130 can be pressed against the pressure roller 150 via the fusing film 110 to provide the nip region N1 between the nip plate 130 (the fusing film 110) and the pressure roller 150.

The shaft 151 of the pressure roller 150 is supported to the bearing member 183 that is in contact with the bearing groove 182A of the lower casing 182. The supporting groove 182B of the lower casing 182 movably supports the side walls 174 of the guide member 170. The side walls 174 of the guide member 170 are supported to the stay 160. Further, all of the shaft 151, the bearing member 183, the lower casing 182, the guide member 170 and the stay 160 have electrically conductive properties. Therefore, an electrical path is formed between the shaft 151 of the pressure roller 150 and the nip plate 130 via the bearing member 183, the lower casing 182, the guide member 170, the stay 160 and the reflection plate 140.

In the present embodiment, the nip plate 130 is electrically grounded via the main frame 2 of the laser printer 1. How to ground the nip plate 130 is not limited to any specific configuration.

Figure 7A:
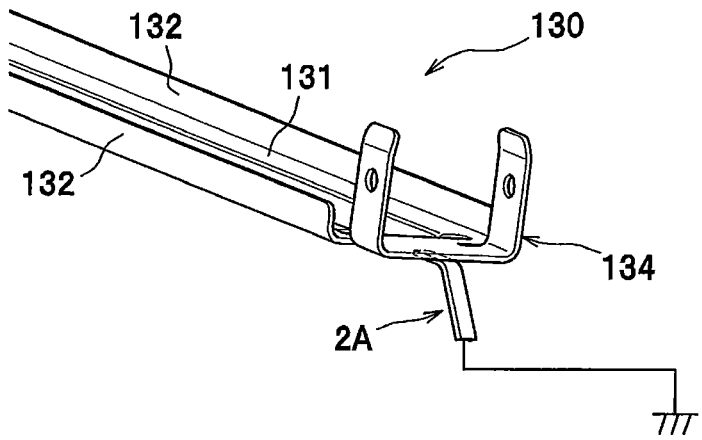
FIG. 7A is a perspective view illustrating an example of a grounding configuration of the nip plate.

For example, FIG. 7A shows an example of possible grounding configurations of the nip plate 130. A leaf spring 2A, which is formed by folding a metal plate and is thus electrically conductive, is in contact with the engagement portion 134 of the nip plate 130.

Figure 7B:
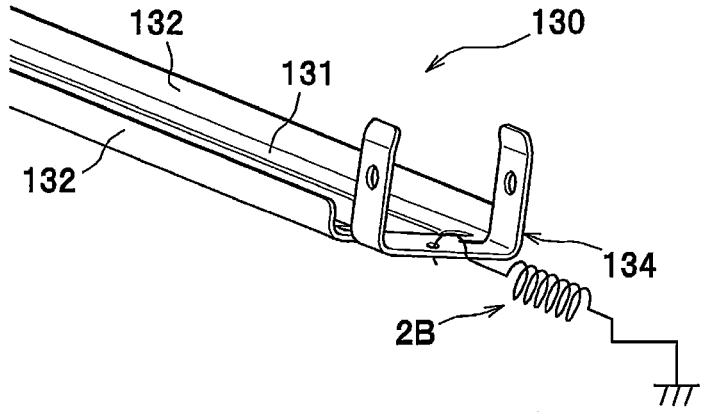
FIG. 7B is a perspective view illustrating another grounding configuration of the nip plate.
Figure 7C:
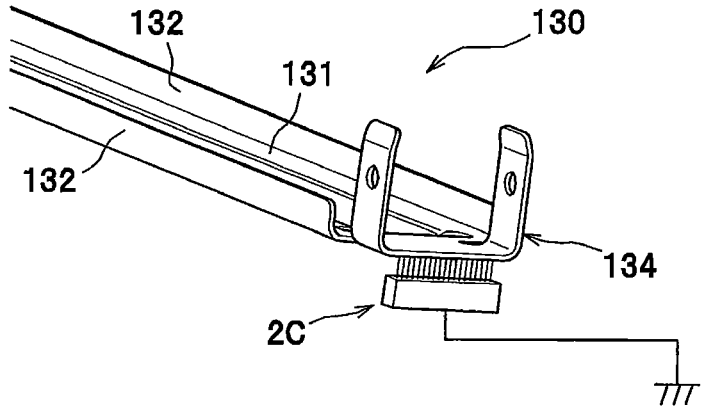
FIG. 7C is a perspective view illustrating still another grounding configuration of the nip plate.

FIG. 7B shows another grounding configuration of the nip plate 130. A grounding wire 2B is engaged with the engagement portion 134 of the nip plate 130. Further, as shown in FIG. 7C, a grounding brush 2C having electrically conductive properties may be brought into contact with the engagement portion 134 of the nip plate 130.

With whichever grounding configuration, since the nip plate 130 is grounded, the fusing film 110 can be electrically grounded via the nip plate 130. Further, grounding of the nip plate 130 enables the reflection plate 140, the stay 160, the guide member 170, the lower casing 182 and the shaft 151 of the pressure roller 150 to be electrically grounded via the nip plate 130.

As described above, the nip plate 130 is electrically conductive, and the fusing film 110 is grounded via the nip plate 130. Therefore, the fusing film 110 can be suppressed from being charged. Further, since the nip plate 130 spans across the entire width of the fusing film 110 and is slidably in contact with the inner circumferential surface of the fusing film 110, the fusing film 110 can be suppressed from being charged with respect to the widthwise direction which is a longitudinal direction of the fusing film 110. Further, simply grounding the nip plate 130, which is an essential member in the fixing device 100, can serve to suppress the fusing film 110 from being charged.

Further, with the above-described configuration, the toner on the sheet P can be suppressed from adhering to the fusing film 110, thereby inhibiting the pressure roller 150 and the next sheet P from being contaminated. Further, since the toner image that is deposited on the sheet P but not yet fixed thereon does not be disturbed, deterioration of image quality can be prevented.

Incidentally, electrical grounding in the present embodiment does not necessarily mean that the electrical charge of the fusing film 110 should become zero, nor the fusing film 110 be indeed directly connected to the ground. As long as the electrical charge on the fusing film 110 can be released to such an extent that the contamination of the pressure roller 150 and the next sheet P can be suppressed and decrease in image quality can be inhibited, the electrical charge of the fusing film 110 may not necessarily be zero, or the fusing film 110 may be connected to the ground via a semiconductor such as zener diode.

Further, in the present embodiment, the nip plate 130 has the center portion 131A that protrudes toward the inner circumferential surface of the fusing film 110. Therefore, even though the lubricant agent G is interposed between the fusing film 110 and the nip plate 130, the electrical conductivity between the fusing film 110 and the nip plate 130 can be enhanced.

More specifically, as shown in FIG. 8, the center portion 131A of the base portion 131 is formed to protrude downward of the both end portions 131B. Therefore, there is formed a gap between the center portion 131A and each of the end portions 131B. With provision of the gap, in accordance with the circular movement of the fusing film 110, the lubricant agent G retained between the respective end portions 131B and the fusing film 110 can enter between the center portion 131A and the fusing film 110 as a thin layer. As a result, in comparison with a state where the lubricant agent G is maintained as a thick layer, the electrical conductivity between the fusing film 110 and the nip plate 130 can be improved.

Further, grounding of the nip plate 130 can reliably make the fusing film 110 and the nip plate 130 electrically connected to each other, compared to cases in which the reflection plate 140 or the stay 160 is grounded. If any member is interposed between the fusing film 110 and the ground, an electrical path therebetween may become unstable due to vibration caused by operation of the fixing device 100. Grounding the nip plate 130 which is directly in sliding contact with the fusing film 110 can lead to a stable electrical connection between the nip plate 130 and the fusing film 110, forming a reliable electrical path therebetween.

Further, in the present embodiment, the shaft 151 of the pressure roller 150 is electrically conductive and electrically connected to the nip plate 130. With this configuration, electrical charges accumulated on a surface of the pressure roller 150 can be released via the shaft 151, so that attraction of the toner deposited on the fusing film 110 to the pressure roller 150 can be suppressed and disturbance of the unfixed toner image on the sheet P can be restricted.

Various modifications are conceivable.

For example, instead of grounding the nip plate 130, the reflection plate 140 or the stay 160 may be grounded since both of the reflection plate 140 and the stay 160 are electrically connected to the nip plate 130. With this configuration, enhanced degrees of freedom can be achieved in designing grounding wires, which can lead to simplification and downsizing of the fixing device 100. Still alternatively, the guide member 170, the fixing frame 180 (lower casing 182) or the shaft 151 of the pressure roller 150 may be grounded.

Further, the lubricant agent G may have conductive properties. For example, an electrically-conductive grease may be employed. By employing such a conductive lubricant agent G, the fusing film 110 and the nip plate 130 can be reliably electrically connected to each other although the lubricant agent G is retained between the fusing film 110 and the nip plate 130.

Figure 9:
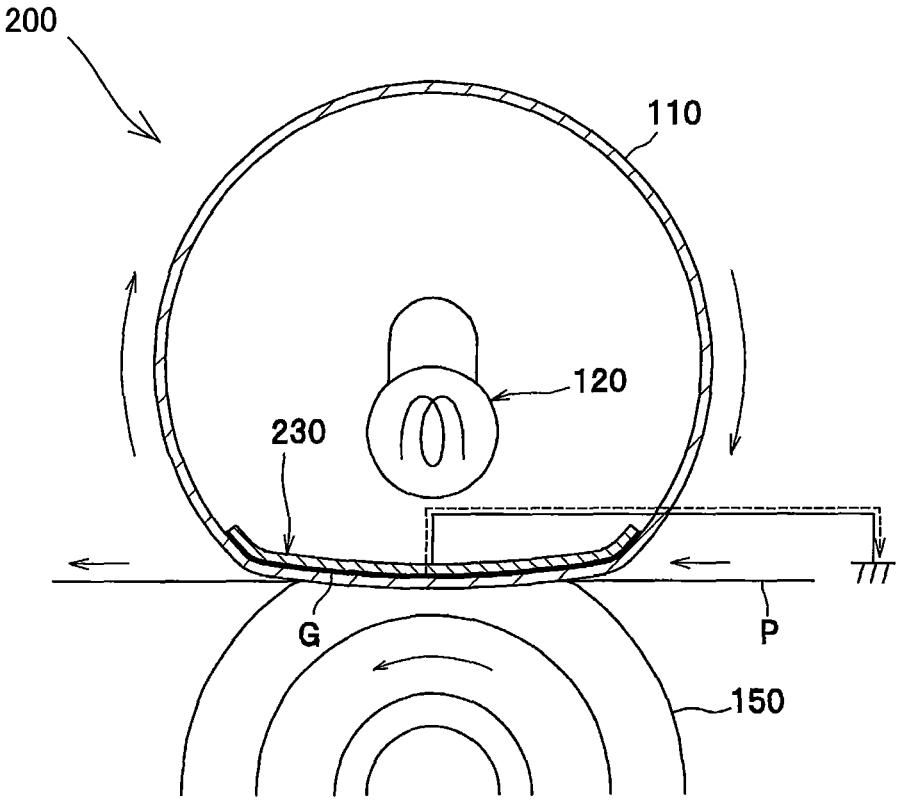
FIG. 9 is a simplified configuration of a fixing device according to a modification of the present embodiment.

Further, the nip plate 130 according to the embodiment has the center portion 131A protruding toward the inner circumferential surface of the fusing film 110, but the configuration of the nip plate 130 is not limited to this configuration. FIG. 9 shows a fixing device 200 according to a modification of the present embodiment. In the fixing device 200, a nip plate 230 as a nip member has a gently curved shape. In the modification, preferably, the lubricant agent G retained between the fusing film 110 and the nip plate 130 be a lubricant agent having electrically conductive properties, such as an electrically-conductive grease. With this configuration, the fusing film 110 and the nip plate 230 can reliably be electrically connected to each other.

Further, as a nip member, the nip plate 130 of the present embodiment is formed with two folded portions 132 extending upward from the front and rear end portions 131B of the base portion 131 respectively. However, a nip member may not be formed with the folded portions, but may have a plate shape.

In the depicted embodiment, the pressure roller 150 is employed as a backup member. However, a belt like pressure member is also available.

Further, in the depicted embodiment, the nip region N1 is provided by the pressure contact of the nip plate 130 (nip member) against the pressure roller 150 (backup member). However, the nip region N1 can also be provided by a pressure contact of the backup member against the nip member.

Further, in the depicted embodiment, the fixing device 100 includes the reflection plate 140 and the stay 160. However, either the reflection plate 140 or the stay 160 can be dispensed with. When a stay is only provided, the stay should be electrically connected to the nip plate 130 directly. When a reflection member is provided, the reflection member may be electrically connected to the nip plate 130 indirectly via a separate member.

Further, an infrared ray heater or a carbon heater is available instead of the halogen lamp 120.

Further, the sheet P can be an OHP sheet instead of a plain paper and a postcard.

Further, in the depicted embodiment, the present invention is applied to the monochromatic laser printer 1 as an example of image forming devices. However, a color laser printer, an LED printer, a copying machine, and a multifunction device are also available.

While the invention has been described in detail with reference to the embodiments thereof, it would be apparent to those skilled in the art that various changes and modifications may be made therein without departing from the spirit of the invention.

What is claimed is:

1. A fixing device for thermally fixing a developing agent image to a sheet comprising:

a tubular flexible member having an inner peripheral surface defining an internal space;

a heater disposed within the internal space and configured to generate radiant heat;

a nip member disposed within the internal space and configured to receive the radiant heat from the heater, the nip member having a first surface configured to contact the inner peripheral surface and a second surface opposite to the first surface, the nip member being electrically conductive, and the tubular flexible member being configured to be grounded via the nip member;

a backup member configured to provide a nip region in cooperation with the nip member for nipping the tubular flexible member between the backup member and the nip member;

a reflection plate disposed within the internal space and configured to reflect the radiant heat from the heater toward the nip member, the reflection plate having an end portion that includes a flange, the reflection plate being electrically conductive and electrically connected to the nip member; and a stay disposed within the internal space and configured to support the nip member and the reflection plate, the stay having an end face facing the flange, the flange of the reflection plate being nipped between the second surface of the nip member and the end face of the stay, the stay being electrically conductive and electrically connected to the nip member via the reflection plate.

2. The fixing device as claimed in claim 1, further comprising a lubricant agent retained between the inner peripheral surface of the tubular flexible member and the first surface of the nip member, the lubricant agent being electrically conductive.

3. The fixing device as claimed in claim 1, further comprising a lubricant agent retained between the inner peripheral surface of tubular flexible member and the first surface of the nip member, wherein the nip member is formed with a portion protruding toward the inner peripheral surface.

4. The fixing device as claimed in claim 3, wherein the lubricant agent is electrically conductive.

5. The fixing device as claimed in claim 1, wherein the nip member is configured to be grounded via a leaf spring.

6. The fixing device as claimed claim 1, wherein the nip member is configured to be grounded via a grounding wire.

7. The fixing device as claimed in claim 1, wherein the nip member is configured to be grounded via a grounding brush.

8. The fixing device as claimed in claim 1, wherein the backup member includes a shaft having an axis that extends in a direction parallel to a widthwise direction of the sheet, and wherein the backup member is configured to rotate about the axis of the shaft, the shaft being electrically conductive and electrically connected to the nip member.

* * * * *